US005540601A

United States Patent [19]

Botchek

[11] Patent Number: 5,540,601

[45] Date of Patent: Jul. 30, 1996

[54] ADAPTER FOR COMPUTER INTERFACE

[75] Inventor: Robert C. Botchek, Milpitas, Calif.

[73] Assignee: Adaptec, Inc., Milpitas, Calif.

[21] Appl. No.: 220,075

[22] Filed: Mar. 30, 1994

[51] Int. Cl.[6] ..... H01R 11/00

[52] U.S. Cl. ..... 439/502; 439/217; 439/218

[58] Field of Search ..... 439/217, 218, 439/221, 224, 680, 333, 502

[56] References Cited

U.S. PATENT DOCUMENTS

| | | | |
|---|---|---|---|
| 2,297,188 | 9/1942 | Joyce | 439/22 X |
| 3,092,430 | 6/1963 | Miller | 439/221 X |
| 4,424,553 | 1/1984 | Marsolli et al. | 439/333 X |
| 4,671,600 | 6/1987 | Sawai et al. | 439/224 X |
| 4,946,401 | 8/1990 | Hori et al. | 439/217 X |
| 4,985,806 | 1/1991 | Mazzullo et al. | 439/224 X |
| 5,387,110 | 2/1995 | Kantner et al. | 439/218 X |

*Primary Examiner*—P. Austin Bradley
*Assistant Examiner*—Daniel Wittels
*Attorney, Agent, or Firm*—Skjerven, Morrill, MacPherson, Franklin & Friel; Forrest E. Gunnison; Omkar K. Suryadevara

[57] ABSTRACT

A structure according to the invention connects a first computer interface to a second computer interface. The first and second computer interfaces can be of any type, such as a SCSI interface and a PCMCIA slot. The structure according to the invention is constructed so that an adapter attached to one of the first or second computer interfaces is multidirectional, i.e., connection pins of the adapter can be oriented in any of a plurality of directions while maintaining the same electronic functionality of the structure according to the invention. The multidirectionality of the adapter enables a user to attach the adapter to the computer interface so that a cable attached to the adapter extends from the adapter into an area that has sufficient room to accommodate the cable.

22 Claims, 10 Drawing Sheets

ADAPTER FOR COMPUTER INTERFACE

BACKGROUND OF THE INVENTION

1. Field of the Invention

This invention relates to a structure for connecting a first computer interface to a second computer interface. More particularly, the invention relates to such a structure where the first computer interface is a PCMCIA socket and the second interface is a SCSI interface.

2. Related Art

Typically, a computer is interconnected by an adapter to peripheral devices, such as printers, CD-ROMs, hard disks and scanners. Interconnection between a computer and a peripheral device (or between peripheral devices) is frequently done with a cable that is configured, at each end of the cable, to be compatible with an interface of the computer or one of the peripheral devices, as appropriate.

Some computers include a slot (interface) for accepting a card that conforms to the Personal Computer Memory Card International Association (PCMCIA) standard. PCMCIA is a widely accepted industry standard for small form factor add-in card applications which are especially popular among users of notebook and sub-notebook computers. A PCMCIA card includes electronic devices, such as printed circuit boards and/or integrated circuit chips, on which circuitry is formed for performing logical functions and/or for storing data. PCMCIA cards generally fall into two categories: 1) memory add-in products including solid state and rotating media, and 2) I/O add-in products such as fax-modems, network adapters, and SCSI adapters.

Many computer peripheral devices utilize an interface bus standard known as Small Computer Standard Interface (SCSI). For example, most CD-ROMs, many high performance/high capacity hard disks and tape drives, scanners, high-speed laser printers and digital cameras implement the SCSI standard.

Without more, a computer equipped with a PCMCIA card slot (and without a SCSI interface) must use PCMCIA-compatible peripheral devices. However, in some cases, the desired device may not exist in a PCMCIA format, or such a device may be redundant with a SCSI peripheral device. In such situations, it desirable to use an adapter that is configured to translate electrical signals between the PCMCIA interface and the SCSI interface. However, such an adapter can be awkward to use with a device equipped with a PCMCIA slot.

SUMMARY OF THE INVENTION

A structure according to the invention connects a first computer interface to a second computer interface. Generally, the first and second computer interfaces can be of any type such as a SCSI interface, a PCMCIA slot, a parallel port, an IDE interface, or any of a number of proprietary bus interfaces developed by companies such as Sony and typically used for CD-ROMs or tape drives. The structure according to the invention is constructed so that an adapter attached to one of the first or second computer interfaces is reversible, i.e., connection pins of the adapter can be oriented in any of a plurality of directions while maintaining the same electronic functionality of the structure according to the invention. The multidirectionality of the adapter enables a user to attach the adapter to the computer interface so that a cable attached to the adapter extends from the adapter into an area that has sufficient room to accommodate the cable.

One embodiment of a structure according to the invention includes a first adapter having a first plurality of electrical contacts and a multidirectional second adapter having a second plurality of electrical contacts. Each of the first plurality of electrical contacts is electrically connected to one of the second plurality of electrical contacts so that the electrical signal pattern of the second plurality of contacts is the same irrespective of the orientation of the multidirectional connector.

Another embodiment of a structure according to the invention includes first and second adapters. The first adapter has a plurality of electrical contacts for making electrical connection to a plurality of electrical terminals of a first computer interface. The second adapter has a plurality of electrical contacts for making electrical connection to a plurality of electrical terminals of a second computer interface. Each of the electrical contacts of the second adapter is electrically connected to one of the electrical contacts of the first adapter so that an electrical signal is sent from each terminal of the first computer interface to a corresponding terminal of the second computer interface, the same electrical signal being sent from each terminal of the first computer interface to the corresponding terminal of the second computer interface irrespective of the orientation of the second adapter with respect to the second computer interface.

Though not necessary, a structure according to the invention can also include structure for electrically connecting the first and second adapters. In one embodiment, when the second adapter is attached to a computer interface in a first orientation, the structure for electrically connecting extends from the second adapter in a first direction, and when the second adapter is attached to the computer interface in a second orientation, the structure for electrically connecting extends from the second adapter in a second direction opposite the first direction. The structure for electrically connecting is, for example, a cable including a plurality of wires, each of the wires electrically connecting the contacts of the first and second adapters.

In one embodiment, the multidirectional adapter includes first and second connectors, the first connector having either contact pins or contact holes and the second connector having the other of either contact pins or contact holes for making electrical connection to the first connector. One or more alignment posts on either the first or second connectors fits into corresponding alignment holes formed in the other of the first or second connectors. The alignment post or posts are of sufficient length so that when the first connector is attached to the second connector, the alignment post or posts extend into the alignment hole or holes so that each of the contact pins are aligned with a corresponding one of the contact holes prior to insertion of each of the contact pins into the corresponding contact hole.

In a particular embodiment of the invention, the first computer interface is a slot for a PCMCIA card and the second computer interface is a SCSI interface.

DETAILED DESCRIPTION OF EMBODIMENTS OF THE INVENTION

Figure 1:
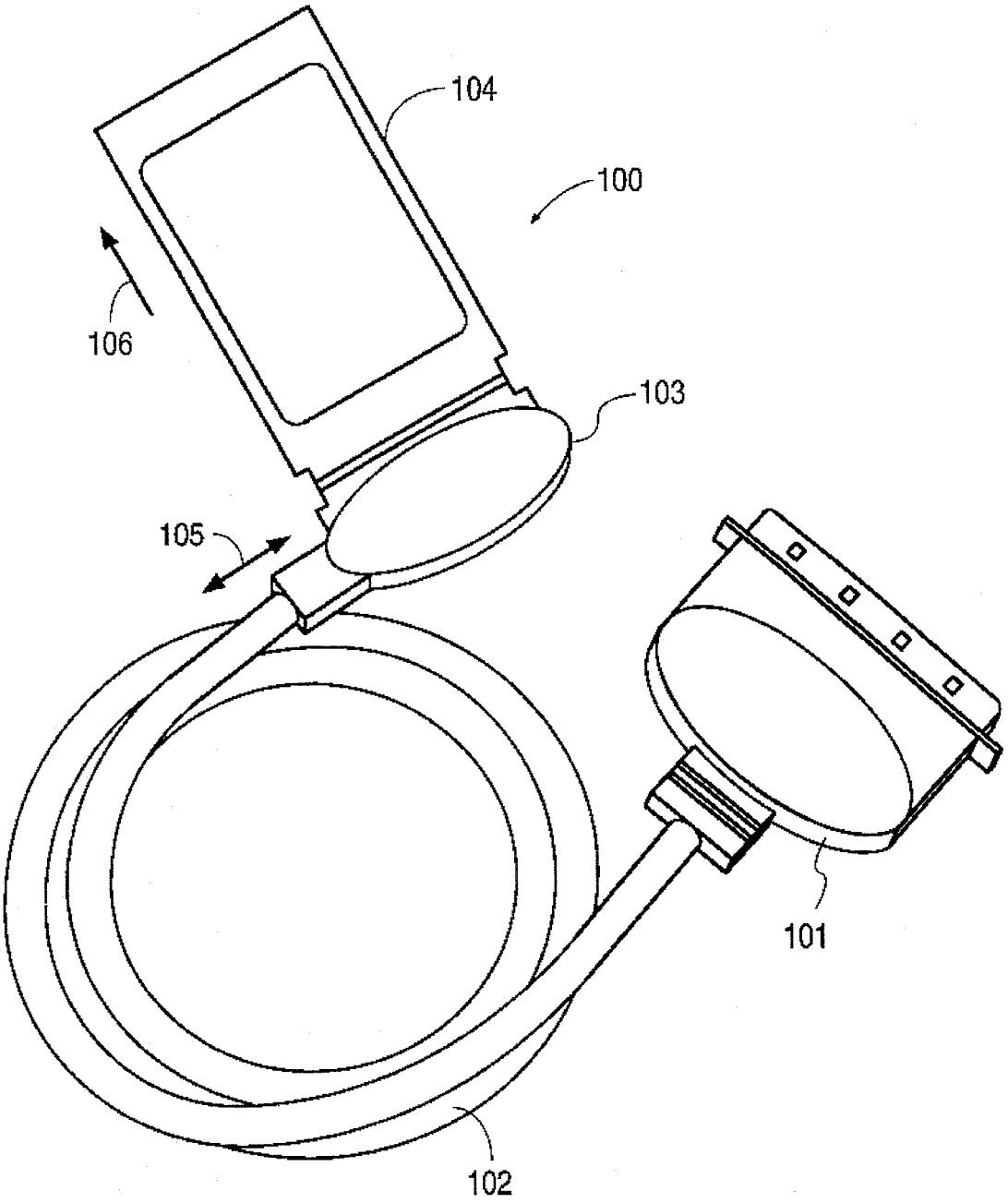
FIG. 1 is a perspective view of a structure according to the invention for connecting a first computer interface to a second computer interface.

FIG. 1 is a perspective view of structure 100 according to the invention for connecting a PCMCIA interface to a SCSI interface. Other structures according to the invention can be used to make connection between other combinations of interfaces. Structure 100 includes standard SCSI connector 101, flexible cable 102, and a PCMCIA adapter including cable adapter 103 and PCMCIA card 104.

In use of structure 100, PCMCIA card 104 is inserted into a compatible PCMCIA slot in a computer. Cable 102 extends from cable adapter 103 in a direction parallel to the plane of PCMCIA card 104 and perpendicular to the direction in which PCMCIA card 104 is inserted into the PCMCIA slot. Cable adapter 103 is detachable from PCMCIA card 104, as explained in more detail below, enabling cable adapter 103 to be flipped over and attached to PCMCIA card 104 so that cable 102 extends from cable adapter 103 in a direction opposite to that shown in FIG. 1.

Cable 102 connects SCSI connector 101 to cable adapter 103. SCSI connector 101 is a 50 pin, shielded connector as specified in the *Small Computer System Interface (SCSI) Specification,* ANSI X3.131-1986, the pertinent disclosure of which is incorporated herein by reference. As more readily understood from the discussion bellows only 36 of the pins (electrical contacts) of SCSI connector 101 are connected to cable adapter 103 through cable 102.

Cable 102 houses twisted wire pairs. In the preferred embodiment of the invention, cable 102 includes 19 twisted wire pairs. Each twisted wire pair is housed in an electrical insulator that is preferably made as thin as possible while maintaining the desired electrical properties. Each of the twisted wire pairs include a ground line and a signal line. Each ground line and signal line are soldered to respective pins of SCSI connector 101. The pin assignments for SCSI connector 101 are shown in Table 1 below and are functionally identical to that shown in the SCSI specification noted above.

TABLE 1

Pin Assignments for SCSI Connector 101

| Pin Number | Signal |
|---|---|
| 1 | GND |
| 2 | GND |
| 3 | GND |
| 4 | GND |
| 5 | GND |
| 6 | GND |
| 7 | GND |
| 8 | GND |
| 9 | GND |
| 10 | N/C (GND) |
| 11 | N/C (GND) |
| 12 | N/C (GND) |
| 13 | N/C (GND) |
| 14 | N/C (GND) |
| 15 | N/C (GND) |
| 16 | GND |
| 17 | N/C (GND) |
| 18 | GND |
| 19 | GND |
| 20 | GND |
| 21 | GND |
| 22 | GND |
| 23 | GND |
| 24 | GND |
| 25 | GND |
| 26 | –DB0 |
| 27 | –DB1 |
| 28 | –DB2 |
| 29 | –DB3 |
| 30 | –DB4 |
| 31 | –DB5 |
| 32 | –DB6 |
| 33 | –DB7 |
| 34 | –DBP |
| 35 | N/C (GND) |
| 36 | N/C (GND) |
| 37 | N/C (GND) |
| 38 | N/C (GND) |
| 39 | N/C (GND) |
| 40 | N/C (GND) |
| 41 | –ATN |
| 42 | N/C (GND) |
| 43 | –BSY |
| 44 | –ACK |
| 45 | –RST |
| 46 | –MSG |
| 47 | –SEL |
| 48 | –C/D |

TABLE 1-continued

| Pin Assignments for SCSI Connector 101 | |
|---|---|
| Pin Number | Signal |
| 49 | –REQ |
| 50 | –I/O |

In Table 1, only 18 signals and 18 grounds are shown as connected from SCSI connector 101. This is because, in the preferred embodiment of the invention, the twisted pair for signal +TERMPWR from SCSI connector 101 is not connected to cable adapter 103. As a result, termination power is not provided to the printed circuit board used to bus signals within cable adapter 103. Since termination power is not necessary to practice the invention, this signal is disconnected to minimize the power drain on the device including the PCMCIA card, which, in practice, is frequently a notebook computer, and to eliminate the necessity to provide a current limit.

Cable 102 also includes a drain wire which electrically connects the metal shield of SCSI connector 101 to a foil shield that surrounds cable 102 and to the shield ground pin at the interface between cable adapter 103 and PCMCIA card 104. In one embodiment, the foil shield is made of aluminum-mylar. The electrical connection between the foil shield surrounding cable 102 and the metal shield of SCSI connector 101 helps reduce electromagnetic interference (EMI), both with nearby electronic devices as a result of the electromagnetic field induced by the flow of current through the conductors within cable 102, and with the conductors within cable 102 as a result of the electromagnetic field caused by the nearby electronic devices.

Each of the signal lines of each twisted pair extend from cable 102 into cable adapter 103 and are soldered to contacts on one side of a printed circuit board inside cable adapter 103. The ground lines are soldered to a ground plane formed on the other side of the printed circuit board. The shield ground line is soldered to a contact on the same side of the printed circuit board as the signal lines, so that the shield ground is electrically isolated from the other ground lines (signal grounds), thus making spurious electrical signals in the signal ground lines smaller than they otherwise would be.

The printed circuit board in cable adapter 103 busses the signal and ground lines to a male connector (described in more detail below with respect to FIGS. 8A through 8C) formed as part of cable adapter 103. The signal lines are bussed through the center of the printed circuit board, while the shield ground is bussed near the periphery of the printed circuit board. The male connector fits into a female connector (described in more detail below with respect to FIGS. 9A through 9D) formed as part of PCMCIA card 104, making electrical contact so that the signals and grounds are transmitted to PCMCIA card 104, as described in more detail below.

The male and female connectors between cable adapter 103 and PCMCIA card 104 each have two rows of 24 pins, a row on each connector corresponding to a row on the other connector. Table 2 shows the pin assignments for the card/adapter interface, i.e., the connection between the male and female connectors. The signals correspond to the SCSI signals of the same name (see Table 1 above).

TABLE 2

| Pin Assignments for Card/Adapter Interface | |
|---|---|
| Pin Number | Signal |
| 1 | Shield GND |
| 2 | GND |
| 3 | –DB0 |
| 4 | –DB1 |
| 5 | –DB2 |
| 6 | –DB3 |
| 7 | –DB4 |
| 8 | –DB5 |
| 9 | –DB6 |
| 10 | –DB7 |
| 11 | –DBP |
| 12 | Vcc |
| 13 | –ACK |
| 14 | GND |
| 15 | –ATN |
| 16 | –BSY |
| 17 | –RST |
| 18 | –MSG |
| 19 | –SEL |
| 20 | –C/D |
| 21 | –I/O |
| 22 | GND |
| 23 | –REQ |
| 24 | GND |
| 25 | GND |
| 26 | –REQ |
| 27 | GND |
| 28 | –I/O |
| 29 | –C/D |
| 30 | –SEL |
| 31 | –MSG |
| 32 | –RST |
| 33 | –BSY |
| 34 | –ATN |
| 35 | GND |
| 36 | –ACK |
| 37 | Vcc |
| 38 | –DBP |
| 39 | –DB7 |
| 40 | –DB6 |
| 41 | –DB5 |
| 42 | –DB4 |
| 43 | –DB3 |
| 44 | –DB2 |
| 45 | –DB1 |
| 46 | –DB0 |
| 47 | GND |
| 48 | Shield GND |

In the preferred embodiment, pins 12 and 37 (the pins connecting to supply voltage $V_{cc}$ on PCMCIA card 104) are not connected between cable adapter 103 and PCMCIA card 104. This reduces power consumption, as explained above with respect to the +TERMPWR signal from SCSI connector 101, from the power supply of the computer device in which PCMCIA card 104 is inserted. In other embodiments of the invention, if desirable for some purpose, $V_{cc}$ pins 12 and 37 can be connected between cable adapter 103 and cable 102.

When cable adapter 103 is connected to PCMCIA card 104, only the SCSI signals on one row ("active row") of the two rows of pins are electrically connected between cable adapter 103 and PCMCIA card 104. As can be seen from Table 2, the order of electrical signals on the second row of 24 pins (i.e., pins 25 through 48) is the reverse of the order of electrical signals on the first row of 24 pins. Thus, PCMCIA card 104 can be connected to cable adapter 103 in either of two orientations (i.e., with either pins 1 through 24 as the top row of pins and pins 25 through 48 as the bottom row of pins, or pins 1 through 24 as the bottom row of pins and pins 25 through 48 as the top row of pins) and maintain the same sequence of electrical connection on the active row of pins.

As described above, cable 102 extends from cable adapter 103 in a direction along a line 105 parallel to the plane of PCMCIA card 104 and perpendicular to the direction 106 in which PCMCIA card 104 is inserted into the PCMCIA slot. Thus, cable 102 typically extends, at least for a short distance, along a side of the computer in which PCMCIA card is inserted.

The PCMCIA slot of different computers is located in different places, some of which may accommodate cable 102 extending in one direction and others of which may accommodate cable 102 extending in the opposite direction. PCMCIA card 104 is keyed so that PCMCIA card 104 can only be inserted into a PCMCIA slot of a computer in one orientation. However, since cable adapter 103 can be connected to PCMCIA card 104 in either of two orientations, cable 102 can extend in either of two directions. Thus, a user can attach cable adapter 103 to PCMCIA card 104 in whichever orientation results in the best accommodation of cable 102 extending from cable adapter 103.

Though only the signal pins in one row of the interface between PCMCIA card 104 and cable adapter 103 are connected, all of the grounds in each row of pins are electrically connected, resulting in a total of 29 electrical connections between cable adapter 103 and PCMCIA card 104: 18 SCSI signal connections, 8 ground connections and 2 shield ground connections. SCSI requires a good ground connection that maintains consistent impedance through cable 102 and cable adapter 103, so that detrimental effects along signal paths such as signal reflections, signal undershoot and signal overshoot are minimized. The quality of the ground connection is affected by the magnitude of the impedance of each section of the ground current path (which is, in turn, a function of the cross-sectional area and length of the section of the ground current path), the number of transitions in impedance along the ground current path, and the magnitude of the impedance transitions.

Cable 102 includes 18 electrically connected ground lines. The printed circuit board in cable adapter 103 includes a ground plane for bussing ground lines. PCMCIA card 104 also includes a ground plane. Consequently, in structure 100, to minimize the above-noted detrimental effects according to the above criteria, it is desirable to provide as many ground connections as possible at the interface between PCMCIA card 104 and cable adapter 103. Since all ground lines in each row of the card/adapter interface are electrically connected, 8, rather than 4, ground connections are made, thus improving the quality of the ground connection between SCSI connector 101 and PCMCIA card 104, thereby minimizing the detrimental transmission line effects noted above.

PCMCIA card 104 includes the electronics for converting electrical signals between the PCMCIA and SCSI formats. The electronics are established so that structure 100 is compatible with PCMCIA PC Card Standard, Release 2.0 or later, the pertinent disclosure of which is incorporated herein by reference, and with SCSI-1 electrical specifications as specified in the *Small Computer System Interface (SCSI) Specification,* ANSI X3.131–1986. The circuitry necessary to convert SCSI electrical signals to PCMCIA electrical signals is apparent to one skilled in the art from review of the above-cited PCMCIA and SCSI specifications.

PCMCIA card 104 has the form factor of a PCMCIA Type II card. The vertical dimension of the cable adapter 103 is greater than the vertical dimension of a PCMCIA Type II Extended card.

Figure 2:
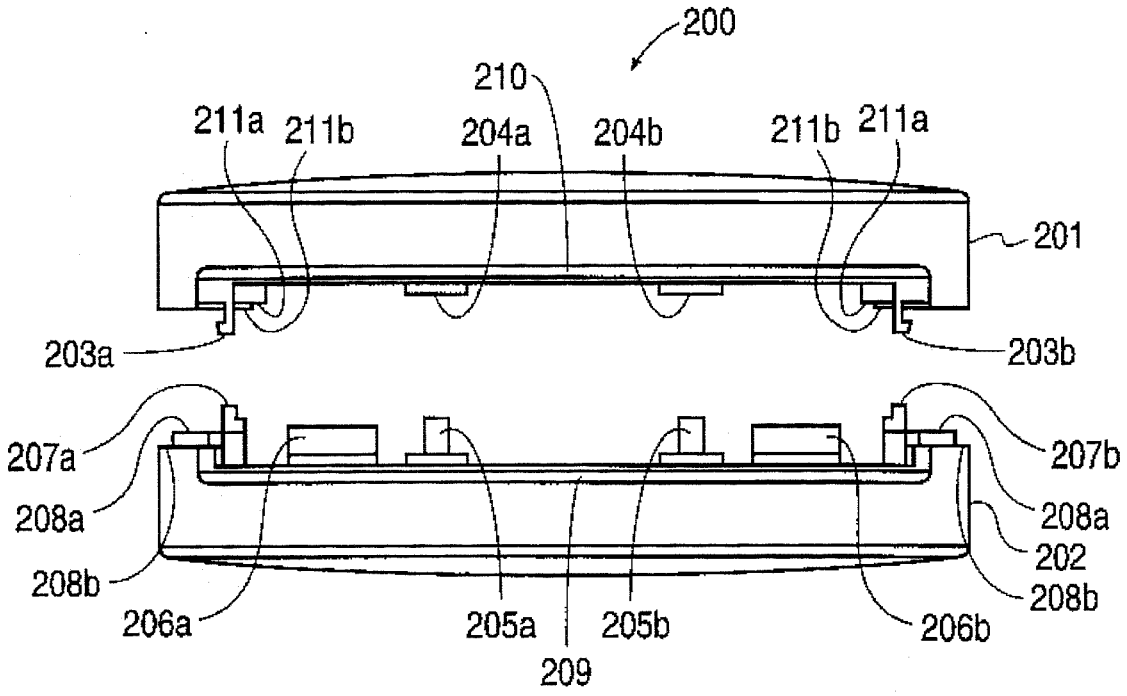
FIG. 2 is a side view of the housing of the cable adapter shown in FIG. 1, illustrating a side of the housing.

FIG. 2 is a side view of housing 200 of cable adapter 103. Housing 200 includes first half (top) 201 and second half (bottom) 202. Top 201 and bottom 202 are attached together to enclose the printed circuit board (not shown), as explained in more detail below, that is used to bus signals from cable 102 to PCMCIA card 104. Top 201 and bottom 202 are made of any lightweight, durable material having adequate strength to resist the stresses to which housing 200 is reasonably expected to be subjected. Illustratively, housing 200 is made of a plastic such as ABS. ABS plastic is available commercially from a number of sources.

Top 201 has a stepped rim 211 (so designated in FIG. 6A) having a portion 211*a* that is lowered relative to a raised portion 211*b*. Bottom 202 also has a stepped rim 208 having a portion 208*a* that is raised relative to a lowered portion 208*b*. When top 201 is attached to bottom 202, raised portion 211*b* of stepped rim 211 of top 201 fits against lowered portion 208*b* of stepped rim 208 of bottom 202, and raised portion 208*a* of stepped rim 208 of bottom 202 fits against lowered portion 211*a* of stepped rim 211 of top 201. Consequently, a side of the raised portion 211*b* of the rim of top 201 contacts a side of the raised portion 208*a* of the rim of bottom 202, thereby holding top 201 and bottom 202 laterally in place with respect to each other.

Posts 205*a* and 205*b* are formed on bottom 202 and, when top 201 is attached to bottom 202, fit into corresponding holes in bosses 204*a* and 204*b* formed on top 201. Holes are formed in the printed circuit board within housing 200. Posts 205*a* and 205*b* extend through the holes, thereby holding the printed circuit board laterally in place.

Legs 203*a* and 203*b* extend from top 201 near the location at which housing 200 interfaces with PCMCIA card 104. Each of legs 203*a* and 203*b* has an L-shaped cross-section so that when top 201 and bottom 202 are attached together, the base of each of legs 203*a*and 203*b* snaps into a corresponding slot (not visible in the Figures) formed in raised section 208*a* of the rim of bottom 202, thereby preventing top 201 and bottom 202 from separating. In one embodiment of the invention, an adhesive is added onto each of legs 203*a* to further secure top 201 to bottom 202.

Figure 4:
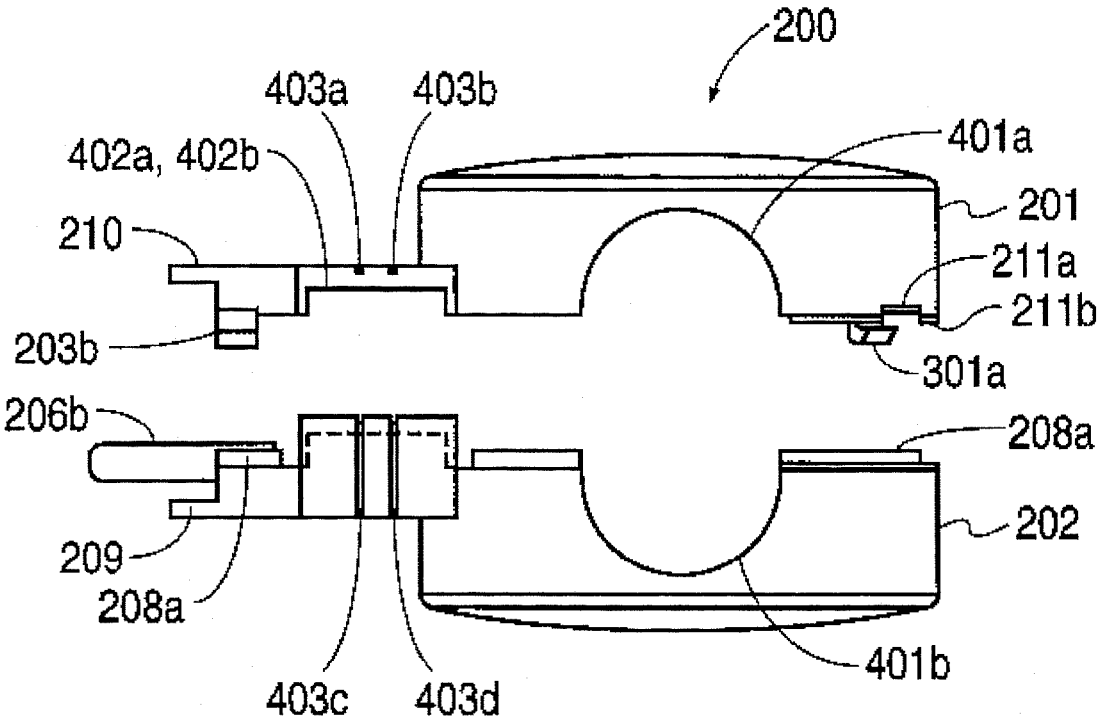
FIG. 4 is an end view of the housing of FIG. 2, illustrating an end of the housing from which the cable shown in FIG. 1 extends.

As best seen in FIG. 4, top 201 has an extending portion 210 and bottom 202 has an extending portion 209 such that, when top 201 and bottom 202 are attached together, a substantially rectangular hole is formed in housing 200 into which PCMCIA card 104 fits. Alignment posts 206*a* and 206*b* extend from bottom 202 past extending portion 209. Each of alignment posts 206*a* and 206*b* have a substantially rectangular shape, though this need not be the case. Alignment posts 206*a* and 206*b* are the male connector (described above with respect to FIG. 1) which fit into the female connector of PCMCIA card 104 to make electrical connection between cable adapter 103 and PCMCIA card 104.

Protruding portions 207*a* and 207*b* extend from bottom 202 toward top 201. Each of protruding portions 207*a* and 207*b* has an L-shaped cross-section such that when cable adapter 103 is assembled, protruding portions 207*a* and 207*b* mate with recesses formed in top 201 to position top 201 and bottom 202 in two axes with respect to each other.

Figure 3:
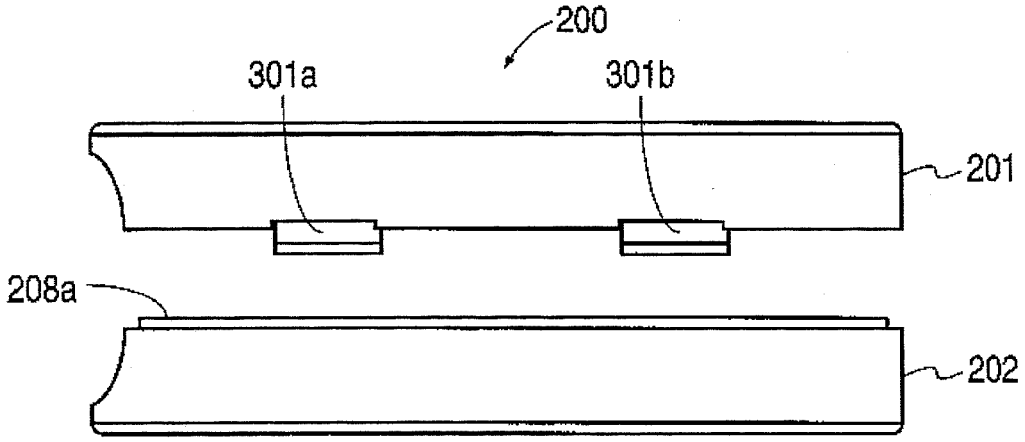
FIG. 3 is a side view of the housing of FIG. 2, illustrating another side of the housing opposite the side shown in FIG. 2.

FIG. 3 is a side view of housing 200, illustrating another side of housing 200 opposite the side shown in FIG. 2. Legs 301*a* and 301*b* extend from raised section 211*b* of the rim of top 201. Each of legs 301*a* and 301*b* has an L-shaped cross-section so that when top 201 and bottom 202 are attached together, the base of each of legs 301*a* and 301*b* fits into corresponding slot 501*a* or 501*b* (FIG. 5) formed in raised section 208*a* of the rim of bottom 202, thereby preventing top 201 and bottom 202 from separating.

FIG. 4 is an end view of housing 200, illustrating an end of housing 200 from which cable 102 (FIG. 1) extends. Top 201 is formed with a recess 401*a* and bottom 202 is formed with a recess 401*b* so that when top 201 is attached to bottom 202, recesses 401*a* and 401*b* together define a hole through which cable 102 fits.

Top 201 is formed with rectangular recesses 402*a* and 402*b*. When top 201 is attached to bottom 202, protruding portions 207*a* and 207*b* (FIG. 2) fit into recesses 402*b* and 402*a*, respectively, so that the base of each of the L-shaped protruding portions 207*a* and 207*b* contacts recesses 402*b* and 402*a*, respectively.

Grooves 403*a* and 403*b* are formed in top 201, and grooves 403*c* and 403*d* are formed in bottom 202, so that when top 201 is attached to bottom 202, grooves 403*a* and 403*c* form one continuous groove around housing 200, and grooves 403*b* and 403*d* form another continuous groove around housing 200. These grooves are not necessary to the invention.

Figure 5B:
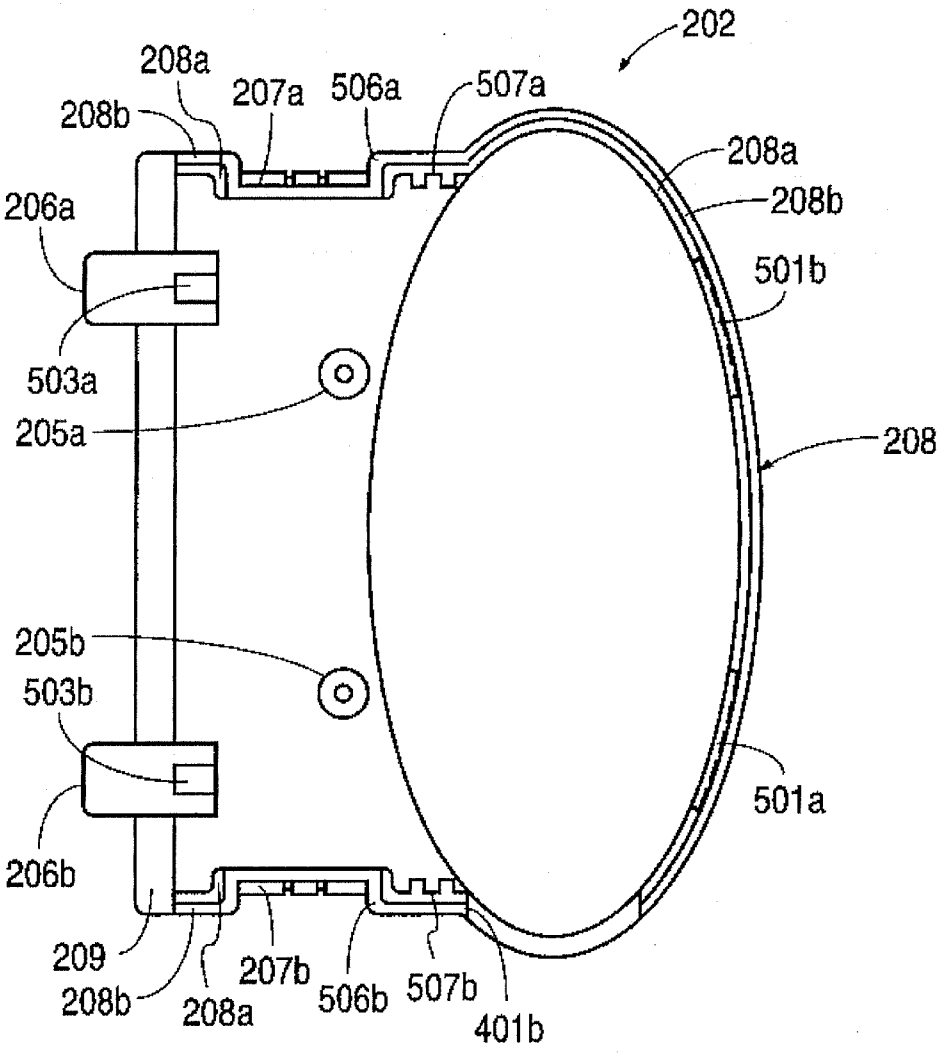
FIG. 5B is a plan view of the interior of the bottom half of the housing of FIG. 2.
Figure 5A:
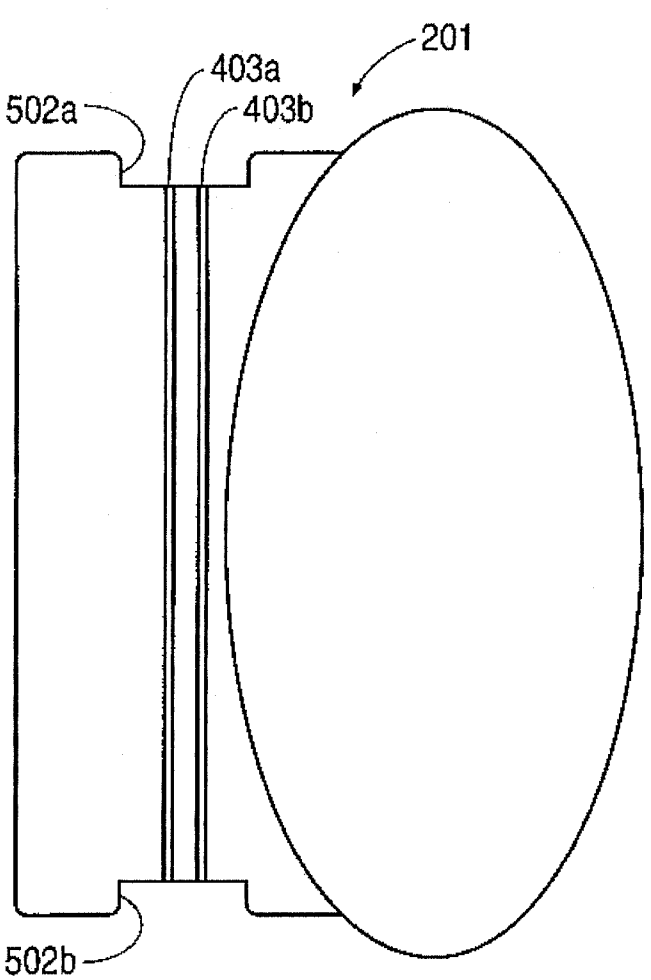
FIG. 5A is a plan view of the exterior of the top half of the housing of FIG. 2.

FIG. 5A is a plan view of the exterior of top 201 of housing 200. FIG. 5B is a plan view of the interior of bottom 202 of housing 200.

Top 201 has rectangular recesses 502*a* and 502*b* formed on opposite sides of top 201. When top 201 is attached to bottom 202, the upright portion of each of the L-shaped protruding portions 207*a* and 207*b* fits against recess 502*a* or 502*b*, respectively.

Bottom 202 is formed with rectangular recesses 506*a* and 506*b* adjacent protruding portions 207*a* and 207*b*, respectively. Recesses 506*a* and 506*b* aid a user in gripping cable adapter 103 when PCMCIA card 104 is being inserted into or withdrawn from a PCMCIA slot.

Two pairs of ridges, each ridge extending perpendicular to the plane of FIG. 5B, are formed on opposite sides of bottom 202, to define slots 507*a* and 507*b*. When top 201 is attached to bottom 202, ridges 601*a* and 601*b* (FIG. 6A) formed on opposite sides of top 201 fit into slots 507*a* and 507*b*, respectively, helping to hold top 201 in place laterally with respect to bottom 202.

Cavities 503*a* and 503*b* are formed in alignment posts 206*a* and 206*b*, respectively. Cavities 503*a* and 503*b* are present to help reduce "dimpling" that may otherwise occur during the plastic injection molding used to form bottom 202, as is well known in the art of plastic injection molding.

Figure 6B:
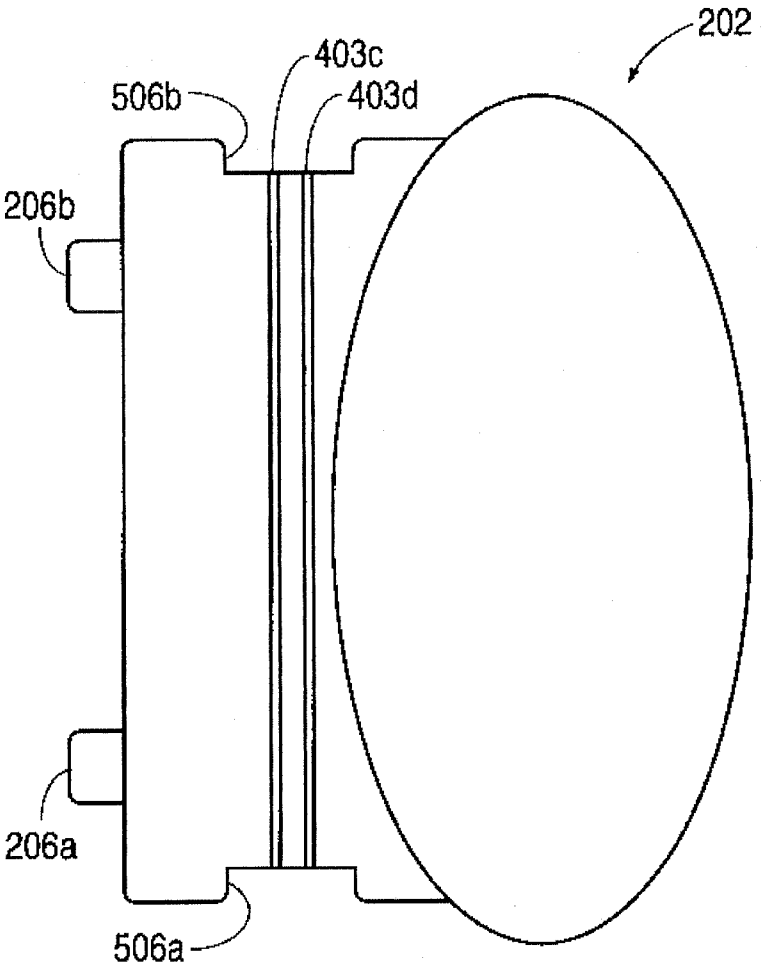
FIG. 6B is a plan view of the exterior of the bottom half of the housing of FIG. 2.
Figure 6A:
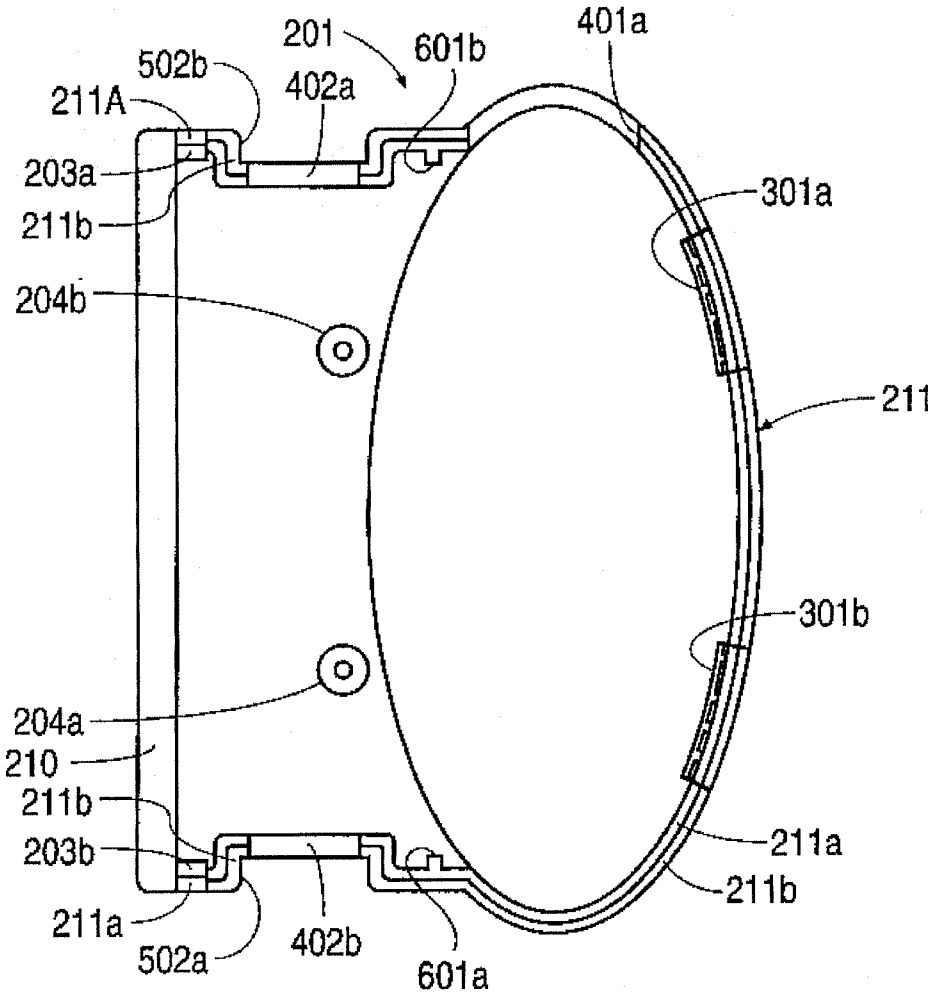
FIG. 6A is a plan view of the interior of the top half of the housing of FIG. 2.

FIG. 6A is a plan view of the interior of top 201 of housing 200. FIG. 6B is a plan view of the exterior of bottom 202 of housing 200. Each of the elements of top 201 and bottom 202 illustrated in FIGS. 6A and 6B have been discussed in more detail above.

Figures 7A, 7B:
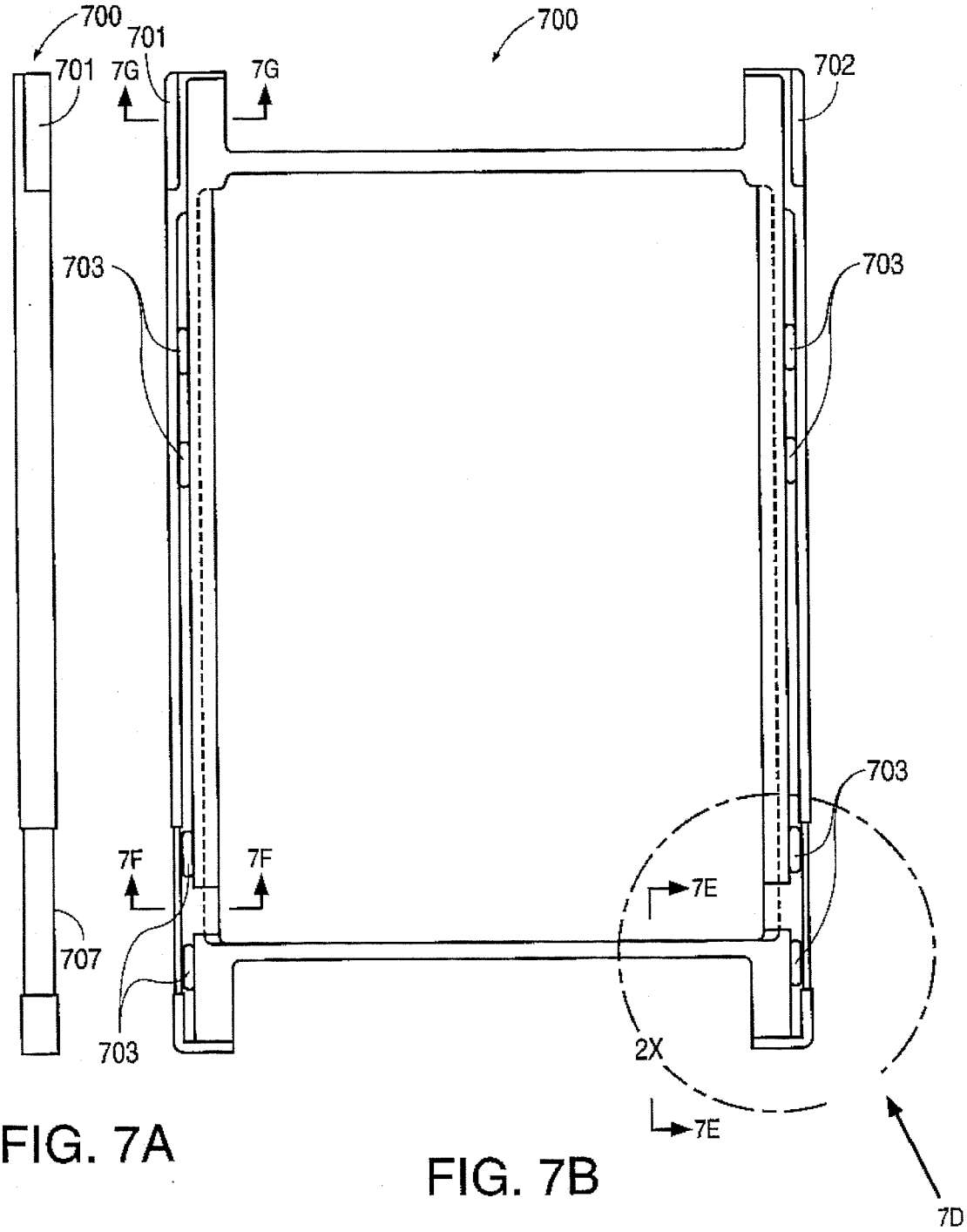
FIG. 7A is a side view of the frame of the PCMCIA card of FIG. 1, illustrating a side of the frame.
FIG. 7B is a plan view of the frame of FIG. 7A.
Figure 7C:
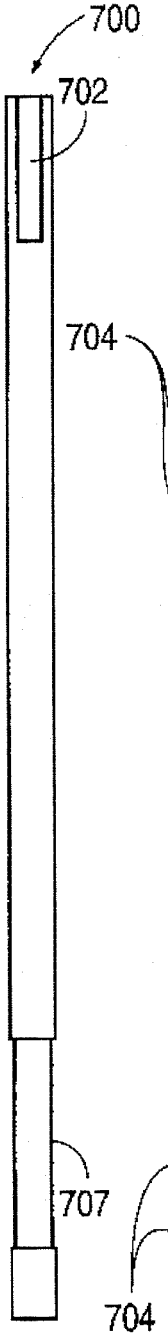
FIG. 7C is a side view of the frame of FIG. 7A, illustrating another side of the frame opposite the side shown in FIG. 7A.
Figure 7D:
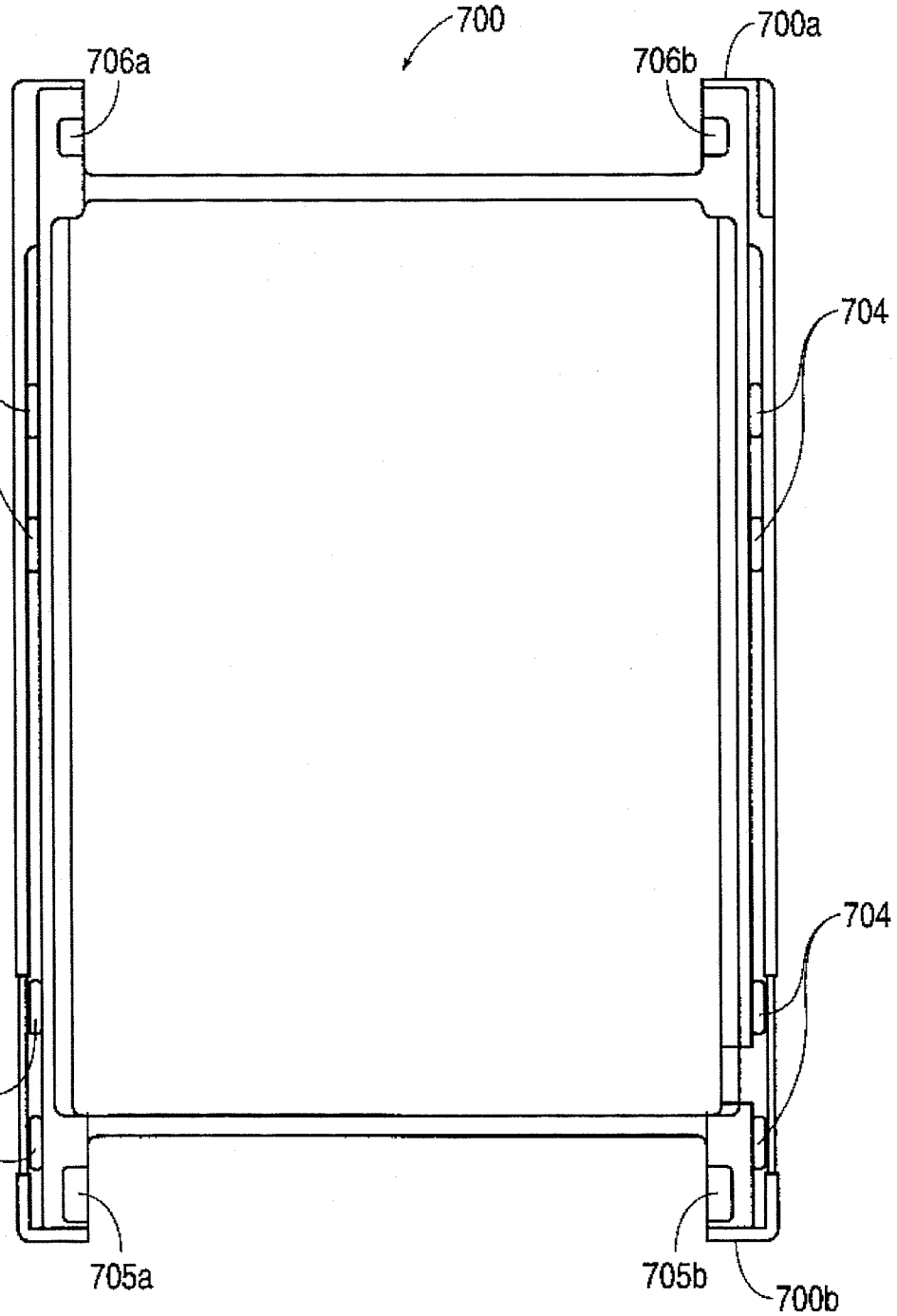
FIG. 7D is a plan view of the frame of FIG. 7A, taken in the opposite direction of the view of FIG. 7B.
Figure 7E:
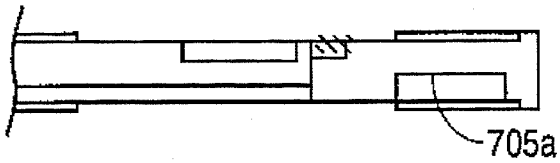
FIG. 7E is a cross-sectional view taken along sectional line 7E—7E of FIG. 7B.
Figure 7F:
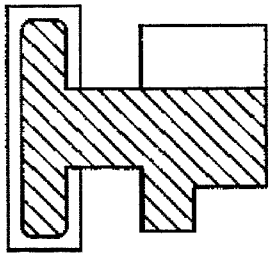
FIG. 7F is a cross-sectional view taken along sectional line 7F—7F of FIG. 7B.
Figure 7G:
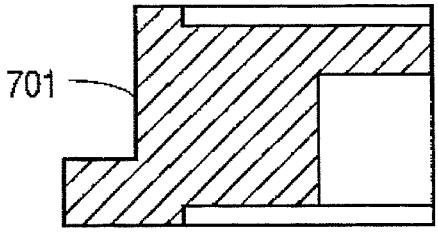
FIG. 7G is a cross-sectional view taken along sectional line 7G—7G of FIG. 7B.
Figure 7H:
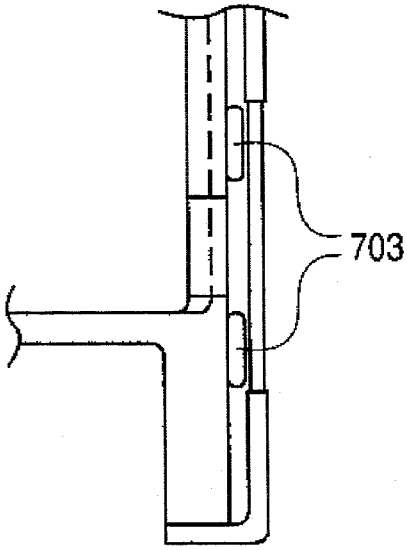
FIG. 7H is a detailed view of the area within circle D of FIG. 7B.

FIG. 7A is a side view of frame 700 of PCMCIA card 104 (FIG. 1), illustrating a side of frame 700. FIG. 7B is a plan view of frame 700. FIG. 7C is a side view of frame 700, illustrating another side of frame 700 opposite the side shown in FIG. 7A. FIG. 7D is a plan view of frame 700, taken in the opposite direction of the view of FIG. 7B. FIG. 7E is a cross-sectional view taken along sectional line A—A of FIG. 7B. FIG. 7F is a cross-sectional view taken along sectional line B—B of FIG. 7B. FIG. 7G is a cross-sectional view taken along sectional line C—C of FIG. 7B. FIG. 7H is a detailed view of the area within circle D of FIG. 7B.

Female connector 900, discussed in more detail below, is mounted on frame 700 near end 700*b* by fitting ears 905*a* and 905*b* (FIG. 9B) of female connector 900 into corresponding cavities 705*a* and 705*b* (FIG. 7D) formed in frame 700. Female connector 900 is attached to a printed circuit board, as explained in more detail below, which is, in turn, attached to another connector (not shown in the Figures) that is mounted on frame 700 using cavities 706*a* and 706*b*.

A lid (not shown) is attached to each side of frame 700 to enclose the printed circuit board and the two connectors. Protrusions formed on a first lid are snap fit into cavities 703 (FIG. 7B) and protrusions formed on a second lid are snap fit into cavities 704 (FIG. 7D).

End 700*a* is inserted into the PCMCIA slot of the computer with which structure 100 is to be used. The sides of frame 700 near end 700*a* are differently keyed, i.e., slots 701 (FIGS. 7A and 7B) and 702 (FIGS. 7B and 7C) are differently shaped, so that PCMCIA card 104 can only be inserted into the PCMCIA slot in one direction.

Indentations 707 (FIGS. 7A and 7C) are formed on either side of frame 700. In one embodiment of the invention, a metal clip is fitted over indentations 707 and the shield ground from cable adapter 103 is connected to the metal clip. However, this is not necessary to the invention and, in the preferred embodiment, this is not done.

Figure 8A:
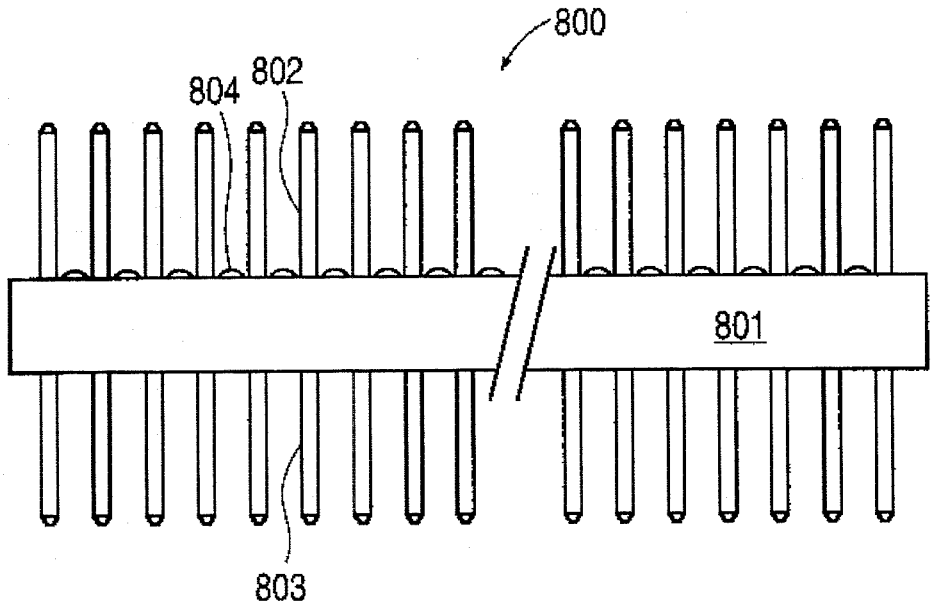
FIG. 8A is a plan view of the male connector of the cable adapter of FIG. 1.
Figure 8B:
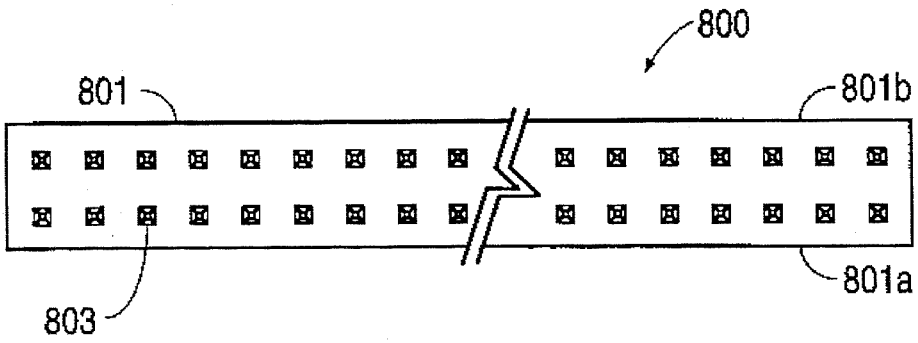
FIG. 8B is a front view of the male connector of FIG. 8A.
Figure 8C:
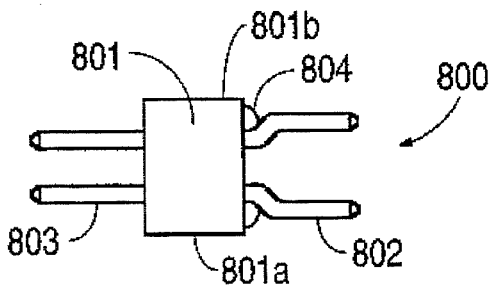
FIG. 8C is a side view of the male connector of FIG. 8A.

FIG. 8A is a plan view of male connector 800 of cable adapter 103 (FIG. 1). FIG. 8B is a front view of male connector 800. FIG. 8C is a side view of male connector 800.

Male connector 800 includes connector body 801, pins 802 and pins 803. Male connector 800 is positioned in housing 200 of cable adapter 103 between alignment posts 206*a* and 206*b* (see FIG. 5B) so that surface 801*a* of connector body 801 contacts extending portion 209 of bottom 202 and surface 801*b* of connector body 801 contacts extending portion 210 of top 201. When housing 200 is assembled, connector body 801 is held in place by the contact with extending portions 209 and 210. Male connector 800 is also held in place by attachment to the printed circuit board within housing 200, as explained in more detail below, which is held laterally in place within housing 200 by posts 205*a* and 205*b* inserted through holes in the printed circuit board, as explained above.

Pins 802 of male connector 800 are formed in two rows. Each pin 802 is formed with a bend near the base of pin 802 so that the distance between the terminal ends of pins 802 in different rows is greater than the distance between the base of pins 802 in different rows. The printed circuit board within housing 200 is positioned between the terminal ends of the two rows of pins 802. Each pin 802 of one of the rows is soldered to a contact pad on one surface of the printed circuit board, and each pin 802 of the other row is soldered to a contact pad on the other surface of the printed circuit board.

Detents 804 are formed at the base of each pin 802 and are made of plastic that is injection molded together with connector body 801. Detents 804 are an artifact of the off-the-shelf connector modified to create male connector 800. Though, in the off-the-shelf connector, detents 804 are present to help in positioning of the printed circuit board with respect to the connector body 801, in male connector 800, detents 804 do not serve this purpose and are not necessary to the invention.

Pins 803 are also formed in two rows. Pins 803 extend through the hole formed by extending portions 209 and 210 (FIG. 4), and are inserted into corresponding contact holes 904 (FIGS. 9B and 9C) formed in female connector 900. Connector body 801 is positioned so that pins 803 do not extend beyond extending portions 209 and 210 so that extending portions 209 and 210 protect pins 803. Pins 803 also do not extend as far from housing 200 as do alignment posts 206*a* and 206*b*, thus enabling alignment posts 206*a* and 206*b* to align pins 803 with corresponding contact holes 904, as explained in more detail below.

Figure 9A:
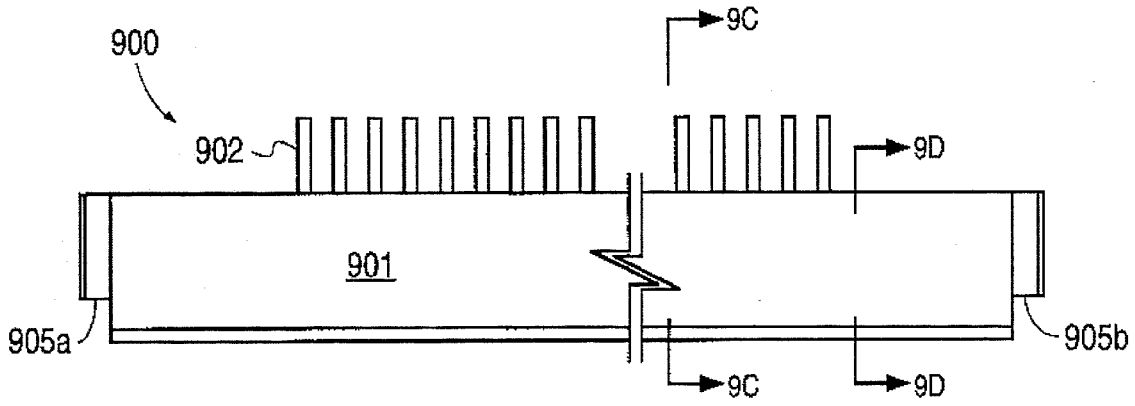
FIG. 9A is a plan view of the female connector of the PCMCIA card of FIG. 1.
Figure 9B:
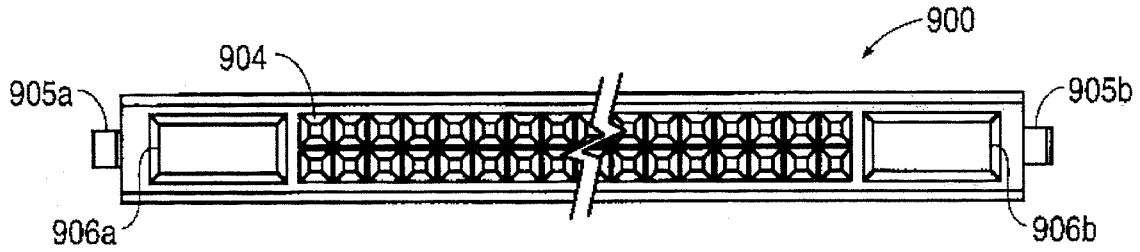
FIG. 9B is a front view of the female connector of FIG. 9A
Figure 9C:
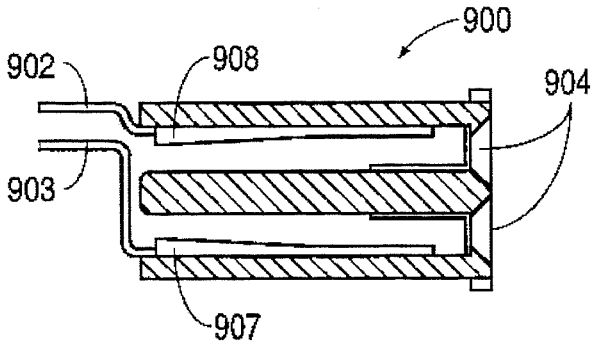
FIG. 9C is a cross-sectional view, taken along section line 9C—9C of FIG. 9A, of the female connector of FIG. 9A.
Figure 9D:
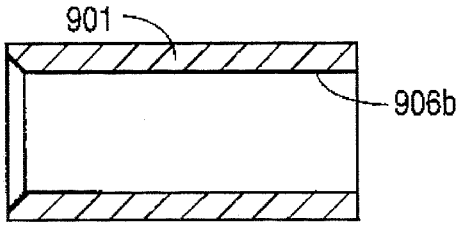
FIG. 9D is a cross-sectional view, taken along section line 9D—9D of FIG. 9A, of the female connector of FIG. 9A, illustrating an alignment hole.

FIG. 9A is a plan view of female connector 900 of PCMCIA card 104 (FIG. 1). FIG. 9B is a front view of female connector 900. FIG. 9C is a cross-sectional view, taken along section line B—B of FIG. 9A, of female connector 900. FIG. 9D is a cross-sectional view, taken along section line A—A of FIG. 9A, of female connector 900, illustrating alignment hole 906*b*.

Female connector 900 includes connector body 901, a first (upper) row of contact pins 902 and a second (lower) row of contact pins 903. A printed circuit board within PCMCIA card 104 and outside of connector body 901 is attached, by, for instance, soldering, between contact pins 902 and 903 so that contact pins 902 and 903 make electrical contact with the printed circuit board. The printed circuit board in PCMCIA card 104 includes the circuitry for converting electrical signals between the PCMCIA and SCSI formats.

Each contact pin 902 or 903 extends into the interior of a corresponding contact hole 904 at an end opposite the end in which pins 803 are inserted. Each contact pin 902 or 903 is attached to the interior of contact holes 904 with, for instance, solder. Each contact pin 902 or 903 makes contact with a corresponding conventional contact wipe 907 located within hole 904.

Ears 905*a* and 905*b* are formed on opposite sides of connector body 901. Ears 905*a* and 905*b* fit into corresponding slots 705*a* and 705*b* of frame 700, as described above with respect to FIG. 7D, to hold female connector 900 in place in frame 700 and to transfer to frame 700 some of the mechanical load to which female connector 900 is subject.

Two rows of contact holes 904 are formed in female connector 900. Alignment holes 906*a* and 906*b* are formed on either side of the two rows of contact holes 904.

Cable adapter 103 is connected to PCMCIA card 104 by first inserting alignment posts 206*a* and 206*b* into alignment holes 906*b* and 906*a*, respectively. As cable adapter 103 and PCMCIA card 104 are pushed together, contact between alignment posts 206*a*, 206*b* and alignment holes 906*a*, 906*b* aligns female connector 900 properly with respect to male connector 800 so that pins 803 will be properly aligned with respect to contact holes 904. Since alignment posts 206*a* and 206*b* extend farther from cable adapter 103 than pins 803, alignment posts 206*a* and 206*b* align pins 803 with corresponding contact holes 904 before pins 803 begin to be inserted into contact holes 904. Cable adapter 103 and PCMCIA card 104 are then pushed together so that pins 803 are inserted into contact holes 904, making electrical connection between cable adapter 103 and PCMCIA card 104.

In addition to aligning pins 803 with contact holes 904, alignment posts 206*a* and 206*b* provide lateral strength to the interconnection between PCMCIA card 104 and cable adapter 103. If a force is applied to move PCMCIA card 104 relative to cable adapter 103 in a direction perpendicular to the direction of alignment posts 206*a* and 206*b*, alignment posts 206*a* and 206*b* contact alignment holes 906*b* and 906*a*, respectively, resisting the movement.

Various embodiments of the invention have been described. The descriptions are intended to be illustrative, not limitative. Thus, it will be apparent to one skilled in the art that certain modifications may be made to the invention as described without departing from the scope of the claims set out below. For instance, though in the above description of the invention, cable 102 connects cable adapter 103 to SCSI connector 101, in view of the above disclosure it is apparent that this need not be so, and that SCSI connector 101 can be connected directly to cable adapter 103.

I claim:

1. A structure, comprising:

a first connector having a first plurality of electrical contacts;

a second connector having a second plurality of electrical contacts; and a cable including a plurality of wires coupling said first connector and said second connector;

wherein when the second connector is attached to a computer interface in a first orientation, the cable extends from the computer interface in a first direction, and when the second connector is attached to the computer interface in a second orientation, the cable extends from the computer interface in a second direction; and further wherein at least one of said electrical contacts in said first plurality is electrically connected by said cable to at least two electrical contacts in said second plurality so that the electrical signal pattern of the second plurality of electrical contacts is the same in both orientations of said second connector.

2. Structure as in claim 1, wherein said cable couples said electrical contact in said first plurality to exactly two electrical contacts in said second plurality, and one of said two electrical contacts in said second plurality is coupled to said computer interface in said first orientation and the other of said two electrical contacts in said second plurality is coupled to said computer interface in said second orientation.

3. Structure as in claim 1, wherein the second connector and the first connector are respectively couplable to a PCMCIA card and a SCSI interface connector.

4. Structure as in claim 1, further comprises:

a first shell section;

a second shell section attached to the first shell section to form an enclosure having an opening;

an alignment post extending through the opening;

wherein said second connector is positioned within the enclosure, the first connector having either contact pins or contact holes that are accessible through the opening; and an adapter formed with an alignment hole and further comprising a third connector having the other of either contact pins or contact holes for making electrical connection to the second connector, wherein:

the alignment post is of sufficient length such that when the second connector is coupled to the third connector the alignment post extends into the alignment hole.

5. Structure as in claim 4, wherein:

the first connector is a male connector;

the third connector is a female connector; and the alignment hole is formed in the female connector.

6. Structure as in claim 4, wherein:

a second alignment post extends through the opening; and a second alignment hole is formed in the third connector, the second alignment post extending into the second alignment hole when the third connector is attached to the second connector.

7. Structure as in claim 1, wherein said second plurality of electrical contacts of said second connector are arranged in two rows, with electrical contacts in a first row numbered A1, A2, through As located opposite to electrical contacts in a second row numbered As+1, As+2, through An;

wherein electrical contacts A1 and An are opposite each other; electrical contacts A2 and An-1 are opposite each other; contacts As and As+1 are opposite each other; and an order of electrical signals on the second row of electrical contacts is reverse of an order of electrical signals on the first row of electrical contacts.

8. Structure as in claim 7 wherein a group of said first row electrical contacts and a plurality of second row electrical contacts are coupled to each other, and are coupled to a ground plane of a PCMCIA card when said second connector is coupled to said PCMCIA card.

9. Structure as in claim 1, wherein said second plurality of electrical contacts of said second connector are arranged in a plurality of rows and a group of electrical contacts in each of said rows are coupled to each other through a ground terminal in said structure.

10. Structure as in claim 9, wherein said plurality of rows is two rows.

11. Structure for connecting a first computer interface to a second computer interface, comprising:

a first connector, wherein the first connector has a plurality of electrical contacts for making electrical connection to a plurality of electrical terminals of the first computer interface; and a second connector, wherein:

the second connector has a plurality of electrical contacts for making electrical connection to a plurality of electrical terminals of the second computer interface, the second connector attachable to the second computer interface in a plurality of orientations;

each of the electrical contacts of the second connector is electrically connected to one of the electrical contacts of the first connector so that an electrical signal is sent from each terminal of the first computer interface to one of two corresponding terminals of the second computer interface; and the same electrical signal is sent from each terminal of the first computer interface to the other of two corresponding terminals of the second computer interface irrespective of the orientation of the second connector with respect to the second computer interface.

12. Structure as in claim 11, wherein the cable includes a plurality of wires, each of the wires electrically connecting one of the plurality of contacts of the first connector to at least one of the plurality of contacts of the second connector.

13. Structure as in claim 11, further comprising a cable electrically coupling the first and second connectors.

14. Structure as in claim 13, wherein:

when the second connector is attached to the second computer interface in a first orientation, the cable extends from the second computer interface in a first direction; and when the second connector is attached to the second computer interface in a second orientation, the cable extends from the second computer interface in a second direction opposite the first direction.

15. Structure as in claim 11, further comprises:

a first shell section;

a second shell section attached to the first shell section to form an enclosure having an opening;

an alignment post extending through the opening;

wherein said second connector is positioned within the enclosure, the first connector having either contact pins or contact holes that are accessible through the opening; and an adapter formed with an alignment hole and further comprising a third connector having the other of either contact pins or contact holes for making electrical connection to the second connector; wherein:

the alignment post is of sufficient length such that when the second connector is coupled to the third connector the alignment post extends into the alignment hole.

16. Structure as in claim 15, wherein:

a second alignment post extends through the opening; and a second alignment hole is formed in the third connector, the second alignment post extending into the second alignment hole when the third connector is attached to the second connector.

17. Structure as in claim 15, wherein:

the first connector is a male connector;

the third connector is a female connector; and the alignment hole is formed in the female connector.

18. Structure for connecting a first computer interface to a second computer interface, comprising:

a first adapter, wherein the first adapter has a first plurality of electrical contacts for making electrical connection to a plurality of electrical terminals of the first computer interface; and a second adapter, wherein:

the second adapter has a second plurality of electrical contacts for making electrical connection to a plurality of electrical terminals of the second computer interface, the second adapter attachable to the second computer interface in a plurality of orientations;

each of the electrical contacts of the second adapter is electrically connected to one of the electrical contacts of the first adapter so that an electrical signal is sent from each terminal of the first computer interface to a corresponding terminal of the second computer interface; and the same electrical signal is sent from each terminal of the first computer interface to the corresponding terminal of the second computer interface irrespective of the orientation of the second adapter with respect to the second computer interface;

wherein the second computer interface is a slot for a PCMCIA card; and the first computer interface is a SCSI interface.

19. Structure as in claim 18, wherein said second plurality of electrical contacts of said second adapter are arranged in a plurality of rows and a group of electrical contacts in each of said rows are coupled to each other through a ground terminal in said structure.

20. Structure as in claim 19, wherein said plurality of rows is two rows.

21. Structure as in claim 18, wherein said second plurality of electrical contacts of said second connector are arranged in two rows, with electrical contacts in a first row numbered A1, A2, through As located opposite to electrical contacts in a second row numbered As+1, As+2, through An;

wherein electrical contacts A1 and An are opposite each other; electrical contacts A2 and An–1 are opposite each other;

contacts As and As+1 are opposite each other; and an order of electrical signals on the second row of electrical contacts is reverse of an order of electrical signals on the first row of electrical contacts.

22. Structure as in claim 21 wherein a group of said first row electrical contacts and a plurality of second row electrical contacts are coupled to each other, and are coupled to a ground plane of a PCMCIA card when said second connector is coupled to said PCMCIA card.

* * * * *